US006645024B1

(12) United States Patent
Zumpano

(10) Patent No.: US 6,645,024 B1
(45) Date of Patent: Nov. 11, 2003

(54) FRESH WATER MARINE ENGINE FLUSHING ASSEMBLY AND SYSTEM

(76) Inventor: Joseph Zumpano, 850 Lugo Ave., Coral Gables, FL (US) 33156

( * ) Notice: Subject to any disclaimer, the term of this patent is extended or adjusted under 35 U.S.C. 154(b) by 56 days.

(21) Appl. No.: 09/992,916

(22) Filed: Nov. 16, 2001

(51) Int. Cl.[7] ..... B63H 21/10
(52) U.S. Cl. ..... 440/88 R; 440/88 N
(58) Field of Search ..... 440/88 R, 113, 440/900, 88 D, 88 M, 88 N; 134/166 R, 167 R, 168 R, 168 C, 167 C, 169 R, 169 A, 169 C; 123/41.01, 41.08, 41.14

(56) References Cited

U.S. PATENT DOCUMENTS

| | | | | | |
|---|---|---|---|---|---|
| 4,619,618 | A | | 10/1986 | Patti | |
| 5,111,762 | A | | 5/1992 | Frangiamore | |
| 5,251,670 | A | * | 10/1993 | Bates et al. | 137/625.46 |
| 5,334,063 | A | * | 8/1994 | Inoue et al. | 440/88 |
| 5,337,774 | A | | 8/1994 | Boyd | |
| 5,362,265 | A | * | 11/1994 | Gervais | 440/88 |
| 5,362,266 | A | * | 11/1994 | Brogdon | 440/88 |
| 5,393,252 | A | | 2/1995 | Brogdon | |
| 5,441,431 | A | | 8/1995 | Brogdon | |
| 5,482,483 | A | | 1/1996 | Rice | |
| 5,628,285 | A | * | 5/1997 | Logan et al. | 123/41.14 |
| 5,671,906 | A | * | 9/1997 | Rosen | 251/148 |
| 5,725,403 | A | | 3/1998 | Ridolfo | |
| 5,746,629 | A | | 5/1998 | Smith | |
| 5,980,342 | A | * | 11/1999 | Logan et al. | 440/88 |
| 6,135,064 | A | * | 10/2000 | Logan et al. | 123/41.14 |
| 6,264,517 | B1 | | 7/2001 | Limoli et al. | |
| 6,343,965 | B1 | * | 2/2002 | Biggs et al. | 440/88 |
| 6,379,201 | B1 | * | 4/2002 | Biggs et al. | 440/88 |
| 6,390,870 | B1 | * | 5/2002 | Hughes et al. | 440/88 |

* cited by examiner

*Primary Examiner*—S. Joseph Morano
*Assistant Examiner*—Ajay Vasudeva
(74) *Attorney, Agent, or Firm*—Ferrell Schultz Carter Zumpano & Fertel, P.A.

(57) ABSTRACT

An assembly structured to flush a cooling system of a marine engine, of varying types, with fresh water, wherein the fresh water is supplied from an on-board, maintained water supply which may also serve as the water supply for drinking, galley appliances, showers, toilets, etc. A path of fluid flow is disposed in fluid communication between the maintained water supply and the marine engine and communicates therewith by an adaptor assembly which is preferably permanently secured to the marine engine. A flush valve assembly is remotely controlled and preferably electronically activated so as to regulate the flow of cooling water through the cooling system, in the conventional manner, or fresh water from the maintained water supply for purposes of moving salt water remnants and contaminants.

38 Claims, 7 Drawing Sheets

FRESH WATER MARINE ENGINE FLUSHING ASSEMBLY AND SYSTEM

BACKGROUND OF THE INVENTION

1. Field of the Invention

The present invention is directed to an assembly and system for flushing the cooling system of a marine engine with fresh water which originates from an on-board, maintained water supply. The maintained water supply may also serve as the primary source of water used for drinking, cleaning, toilet functions, etc.

2. Description of the Related Art

The internal flushing of marine engines, of varying types, especially when the water craft and associated marine engine is used in salt water is often problematic and time consuming. However, the flushing procedure of the engine's cooling system is normally considered imperative to extending the life of the engine and assuring its reliable operation. After use, and depending upon the marine environment in which the boat is operated, the engine may contain salt water, sand, mud, and a variety of different contaminants or debris, all of which have a tendency to corrode the engine if not properly removed on a timely basis. Often after each use, the boat operator must flush the cooling system of the engine mechanically, using an external, fresh water source and one or more flushing devices which are known and commercially available.

In general terms the cleaning or flushing process may involve the forcing of clean or fresh water through the cooling system of the engine to remove the salt water and other contaminants therefrom. This is accomplished by introducing a forced flow or stream of water through the cooling system. However, the majority of the more commonly used flushing devices are for the most part externally applied. As such, these known devices must be attached to the marine engine in some effective manner so as to establish fluid communication with the interior of the engine and the cooling system in particular. The aforementioned external water source used to create the forced flow of fresh water through the engine is commonly a conventional water hose.

Other known or conventional methods include the use of mechanical devices applied to the engine, and/or to the water hose which is used as the supply of fresh flushing water. Examples of such devices are commonly known as "earmuffs" which serve to attach the water hose to the water inlet at the bottom of engine column, such as in an outboard or outboard/inboard motor. It is well recognized that such conventional techniques are inconvenient in that a water hose of sufficient length is frequently not available. Also the flushing of the cooling system of various types of marine engines involve other mechanical devices or procedures which have a tendency to tax the physical stamina or at the very least requires a significant amount of time being spent.

In an effort to overcome many of the disadvantages and problems of the type set forth above a number of different approaches to flushing fresh water through a marine engine have been attempted. By way of example only, it is also known to provide portable flushing assemblies which include the use of a portable, external water reservoir structured for the temporary storage of water. Utilizing such a system or procedure still requires a supply of water being connected to the temporary reservoir and therefore involves the use of a water hose of the type set forth above. In addition, such known systems must also include some type of delivery system which serves to establish a fluid connection or communication between the temporary water reservoir and the cooling system or interior workings of the marine engine. As such, a delivery system often requires the use of a water pump which in turn necessitates access to some type of power source not associated with the water craft.

The inconvenience of such known or conventional marine engine flushing systems is therefore apparent. While, it is assumed that known flushing devices and procedures of the type set forth above may be at least minimally operative for their intended function and purpose, they do not significantly overcome long recognized problems and disadvantages existing in the marine industry. This is at least partially due to the fact that known systems of the type described still have to be connected to and disconnected from the engine being flushed. Such systems still require establishing fluid communication with a conventional source of water each time the flushing system is utilized. Other known disadvantages associated with conventional flushing systems or devices comprise the inability to effectively flush a marine engine when the water craft is not operating or is in a location which prevents the operation of the marine engine in a safe manner.

Accordingly, there is a significant and long recognized need in the marine industry for an improved flushing assembly and system which overcomes the problems and disadvantages of the type set forth above. Such an improved flushing assembly should be unique in its operation, at least to the extent of being continuously disposed in an operative position including being permanently attached to the marine engine. As such, the improved flushing assembly should be operative to provide for the passage of cooling water through the marine engine in the conventional fashion while the marine engine is operating to power the water craft. In addition, a preferred and improved flushing assembly and system should not rely on access to a conventional water source not associated with the water craft, such as a water hose, each time flushing of the marine engine is required.

To the contrary, a preferred flushing assembly should have an established access to an existing path of fluid flow disposed between a permanent, on-board, continuously maintained fresh water supply and the marine engine. Such a fresh water supply could also be the common source of water for other applications on the water craft and/or be provided in the form of an auxiliary fresh water reservoir. Such an auxiliary reservoir would also be permanently maintained on-board the water craft. In either of these embodiments a supply of fresh water would be continuously available for the flushing of the marine engine whenever and wherever the operator deems necessary.

Finally, such an improved flushing assembly and system should be capable of being either remotely controlled such as by electrical activation of the operative components thereof.

Alternatively and/or in conjunction with the remote control and electrical activation, the control of fresh water from the maintained water supply should be capable of being manually controlled or activated. The permanently installed nature of such a preferred flushing system and assembly allows the operation of the marine engine in a conventional fashion, wherein cooling water is forced through the marine engine. Also, after operation of the engine it may be flushed with fresh water without requiring any connection/disconnection of externally mounted devices, as is common in conventional flushing assemblies.

SUMMARY OF THE INVENTION

The present invention is directed towards an assembly and system structured to flush one or more marine engines of a water craft with fresh water in a manner which overcomes the disadvantages and problems associated with conventional or known flushing systems. At least one distinguishing feature of the various preferred embodiments of the flushing assembly and system of the present invention is the utilization of fresh water permanently stored on-board the water craft as a maintained water supply. Depending upon the size and purpose of a given water craft, a permanent water reservoir is normally included as part of the craft's operating equipment. Water is maintained within the permanent reservoir and utilized for a variety of utilitarian purposes such as drinking, cleaning, toilet operation, etc.

Therefore, the flushing assembly and system of the present invention utilizes the stored fresh water from the maintained water supply to flush the cooling system of the one or more marine engines associated with the water craft. It is of course recognized that the water in the maintained water supply will have to be periodically replenished because of normal use of the various facilities on the water craft. However, the flushing system and assembly of the present invention will eliminate the inconvenience, physical effort and wasted time associated with locating and utilizing a water hose and/or an off-board, temporary reservoir each time the marine engine must be flushed.

Therefore, it is emphasized that the term "maintained water supply" is intended to include a supply of water maintained on-board the water craft in a substantially permanent reservoir, as set forth above. However, this term is also meant to include any auxiliary or augmented supply of fresh water maintained in a reservoir on-board the water craft, whether or not such auxiliary water supply is directly associated with the primary source of fresh water, as indicated above, or is used primarily for the flushing of one or more marine engines.

Accordingly, the flushing assembly and system of the present invention comprises a path of fluid flow disposed in fluid communication between the maintained water supply and the one or more marine engines which are to be flushed. Upon activation, a stream of water is forced to travel along the path of fluid flow upon activation of a water pump. The water pump may be an auxiliary pump specifically associated with the flushing assembly of the present invention. Alternatively, a water pump already installed on the water craft and used to force water flow from the maintained water supply to any other facility on the water craft may be adapted for use in supplying fresh, flushing water to the marine engines.

Unlike many if not all the conventional or known flushing devices, at least one preferred embodiment of the present invention includes an adaptor assembly which preferably is permanently mounted to the one or more marine engines and serves to establish a stable connection between the path of fluid flow and the marine engines being cleaned. As such, the adaptor assembly comprises at least one adaptor member secured directly to a conventional water outlet associated with each of the marine engines to be flushed. The water outlet is normally provided for the discharge of cooling water which is forced through the cooling system of the marine engine during the normal operation thereof as the craft travels through water.

Further, the adaptor assembly comprises an individual adaptor member for each of the marine engines and, as set forth above, a permanent securement or mounting of the respective adaptor members are provided. The term "permanent" as used herein is meant to describe a mounting, connection, or attachment of the adaptor member which remains in place during the normal operation of the marine engine. Naturally, even with the aforementioned permanent mounting, connection, etc. the one or more adaptor members may be removed for repair, replacement maintenance, etc. while still being accurately described as permanently mounted or connected to the marine engine. Accordingly, the structure of the adaptor assembly, and in particular the adaptor member associated with each marine engine, allows for the flow of cooling water therethrough as it is being discharged from the cooling system during the normal operation of the engine. Alternately, fresh water passes through the adaptor member, during the flushing procedure, as the water enters the cooling system from the path of fluid flow and exits through the normal cooling water inlet associated with the marine engine.

As set forth above, the adaptor assembly is structured to interconnect the path of fluid flow in fluid communication with the cooling system of the marine engine. However, one feature of the various preferred embodiments of the present invention is the provision of a flush valve assembly disposed and structured to at least partially regulate and determine the flow of water into and out of the marine engine. As such, the flush valve assembly, in at least one preferred embodiment of the present invention, is remotely controlled and electronically activated so as to be selectively positioned into and out of a plurality of operative positions.

Therefore, at least one of the plurality of operative positions provides for the flow of water from the path of fluid flow through the flush valve assembly and the corresponding adaptor member into the cooling water outlet of the marine engine and through the cooling system thereof. The flush valve assembly may also be selectively oriented into at least a second of the plurality of operative positions. When in the second operative position, fluid communication between the path of fluid flow and the marine engine is restricted as cooling water enters the cooling water inlet of the marine engine and passes through the cooling system in the normal fashion when the engine is operating. The cooling water is then discharged from the outlet of the marine engine through the adaptor assembly and flush valve assembly to an area of normal or specifically directed discharge.

While the flush valve assembly, in at least one preferred embodiment of the present invention, is remotely controlled and electrically activated, it is also capable of being manually controlled and actuated through the manipulation of the various components of the flush valve assembly, as will be described in greater detailed hereinafter. However, in a most preferred embodiment of the present invention the flush valve assembly can be remotely controlled to accomplish its orientation into and out of the plurality of operative positions. Remote control of the flush valve assembly allows the operator of the water craft, such as while located at the controls thereof, to accomplish either conventional cooling of the marine engine when it is operating in the normal and intended fashion or alternatively the flushing of the one or more marine engines with fresh water from the aforementioned on-board, maintained.water supply.

Electrical activation of a magnetic switching assembly, or other operative switching structure, facilitates the remote control. In the one or more preferred embodiments incorporating the remote control and electrically activated flush valve assembly, the power source for the activation thereof can be derived from the conventional, on-board power source of the water craft. Similarly, the aforementioned water pump and other operative components to be described herein can similarly be operated, controlled and activated to accomplish the efficient and effective operation of the flushing assembly and system of the present invention.

These and other objects, features and advantages of the present invention will become more clear when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
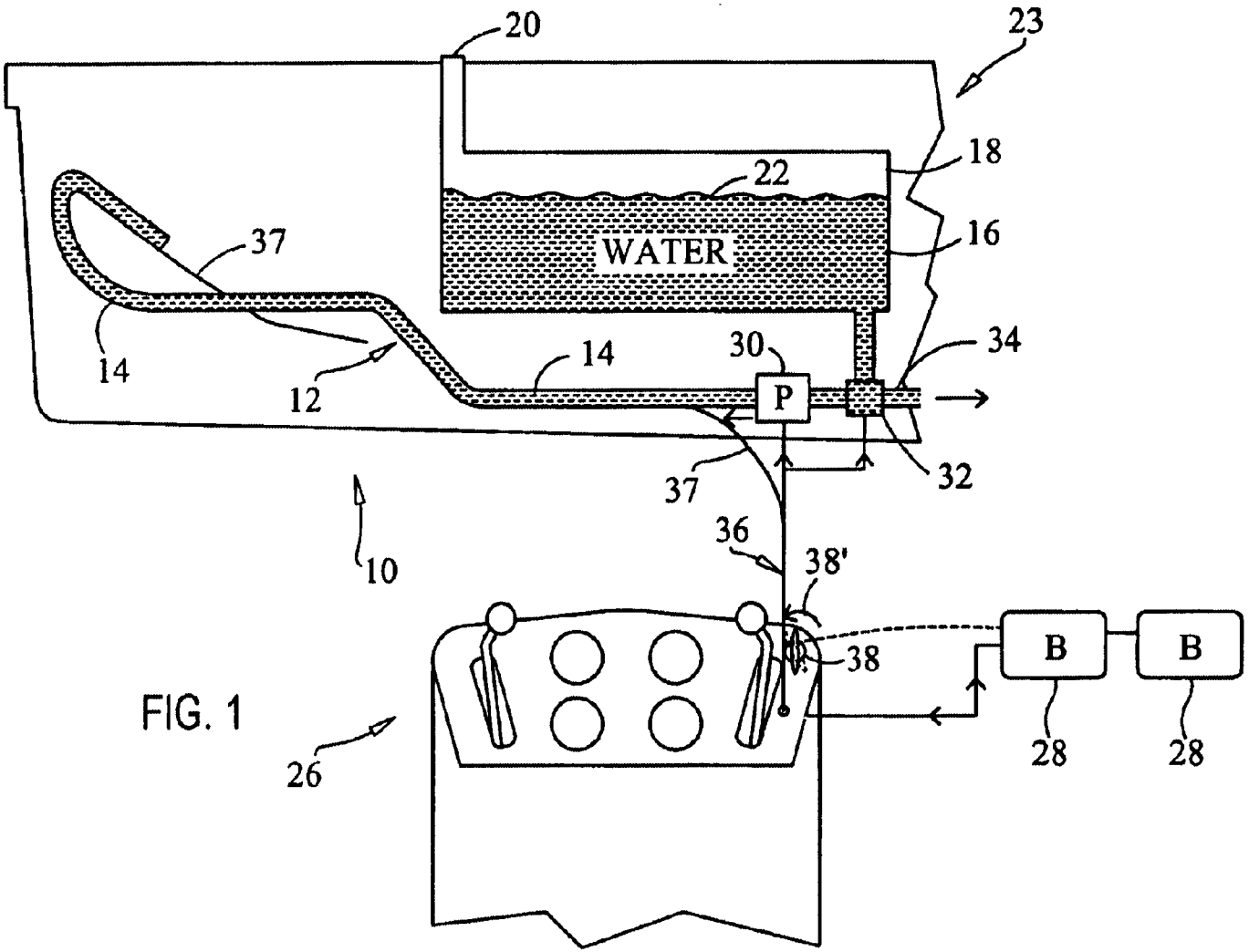
FIG. 1 is a schematic view in partial cutaway showing an overview of at least a portion of the flushing assembly and system of the present invention.

As shown in the accompanying drawings, the present invention is directed to a flushing assembly and system shown, at least in part, in FIG. 1 and generally represented therein as 10. More specifically, the flushing assembly and system 10 of the present invention comprises a path of fluid flow generally indicated as 12 including at least one conduit 14. The path of fluid flow 12, including the conduit 14, extends between and in fluid communication with an on-board, maintained water supply, generally indicated as 16 and one or more marine engines 25 on the water craft 23. The maintained water supply includes a permanent reservoir 18 having a conveniently located fill structure 20 and being dimensioned and configured to store a quantity of fresh water, generally indicated as 22. Accordingly, the flushing assembly and system 10 of the present invention is clearly distinguishable from conventional or known marine engine flushing systems by utilizing the fresh water 22 maintained within the reservoir 18 of the maintained water supply 16, as a source of fresh flushing water.

Depending at least on its size and intended use a water craft, such as the water craft 23, includes a substantially permanent water reservoir 18 as part of the normal operating equipment thereof. As such, the fresh water 22 is maintained within the permanent reservoir 18 and utilized for a variety of utilitarian purposes such as, but not limited to, drinking, showering, toilet operation, etc. While it is recognized that the quantity of fresh water 22 stored within the maintained water supply 16 will have to be periodically replenished because of normal use of the various facilities of the water craft, the maintained water supply 16 is herein referred to and comprises the substantially permanent, on-board reservoir 18. Accordingly, it is emphasized that the term "maintained water supply" is meant to include a supply of water continuously maintained on-board the water craft 23 in a substantially permanent reservoir 18, wherein the reservoir 18 may also serve as the primary source of water for other utilitarian purposes aboard the water craft 23. In addition, the term "maintained water supply" is also meant to include any auxiliary supply of water maintained in an associated or segregated reservoir on-board the water craft 23. Such an auxiliary, maintained water supply may be directly associated with the primary water supply 16 by serving as a supplement thereto or may be used exclusively for the flushing of the one or more marine engines 25.

As also described in greater detail hereinafter, operation of the flushing assembly and system 10 of the present invention may be remotely controlled and/or electrically activated such as from a control console 26. Accordingly, when energized, electrical power from the batteries 28, or other source of electrical energy, serves to activate a water pump 30 in order to create a forced flow of water from the maintained water supply 16 through the conduit 14 of the path of fluid flow 12 to the marine engines 25.

A flow control valve 32 may be appropriately located in fluid communication between the maintained water supply 16 and a delivery conduit 34. The delivery conduit 34 is normally used to deliver the fresh water 22 to the various utilities or appliances on-board the water craft 23 which normally use water, as set forth above. Therefore, when activated the flow control valve 32 is disposed and structured to prevent water from flowing through the supply conduit 34. Instead water 22 is directed through conduit 14 of the path of fluid flow 12 due to the activation of the water pump 30. It is also emphasized that the water pump 30 may be disposed in a variety of locations other than that schematically represented in FIG. 1 and may be structured for exclusive operation with the forcing of water along the path of fluid flow 12. Alternatively, the water pump 30 may be a normal operative component of the water craft 33, such as of the type used to force the flow of water from the maintained water supply 16 to the other facilities aboard the water craft 23.

Remote control and electrical activation of the water pump 30 and/or flow control valve 32 is further facilitated by an electrical conductor assembly 36. A control facility generally indicated as 38 is connected to the conductor assembly 36 and is preferably located on the control console 26 or at a variety of other locations on the water craft 23, which may be remotely spaced from the marine engines 25. Further, the electrical conductor 36 includes at least one additional electrical conductor 37 for supplying electrical current to a flush valve assembly 40. The flush valve assembly 40 is disposed and structured to regulate fluid flow into and out of the one or more marine engines 25, as will be explained in greater detail hereinafter. The conductor structure 37 may be disposed along any appropriate path on or within the water craft 23. However in at least one preferred embodiment, the electrical conductor 37 follows the path of the conduit 14 which in turn defines the path of the fluid flow 12 of fresh water from the on-board, maintained water supply 16 to the one or more marine engines 25.

The flushing assembly and system 10 of the present invention further includes an adaptor assembly generally indicated as 42 and comprising at least one adaptor member 44 associated with each of the one or more marine engines 25. The adaptor assembly 42 is disposed and structured to interconnect the path of fluid flow 12, or conduit 14, in fluid communication with the interior of the cooling system of the one or more marine engines 25. As such, each adaptor member 44 is "permanently" mounted or secured to a conventional water outlet 43 or 43' associated with the one or more marine engines 25. The permanent connection or mounting of the adaptor member 44 on a corresponding marine engine 25 is meant to describe the fact that the adaptor member remains in place on the marine engine 25 continuously, during both operation of marine engine and the flushing thereof. Naturally, it is acknowledged that the one or more adaptor members 44 may be removed for purposes of replacement, repair, maintenance, etc. and still be accurately described by the term "permanent".

Figure 8:
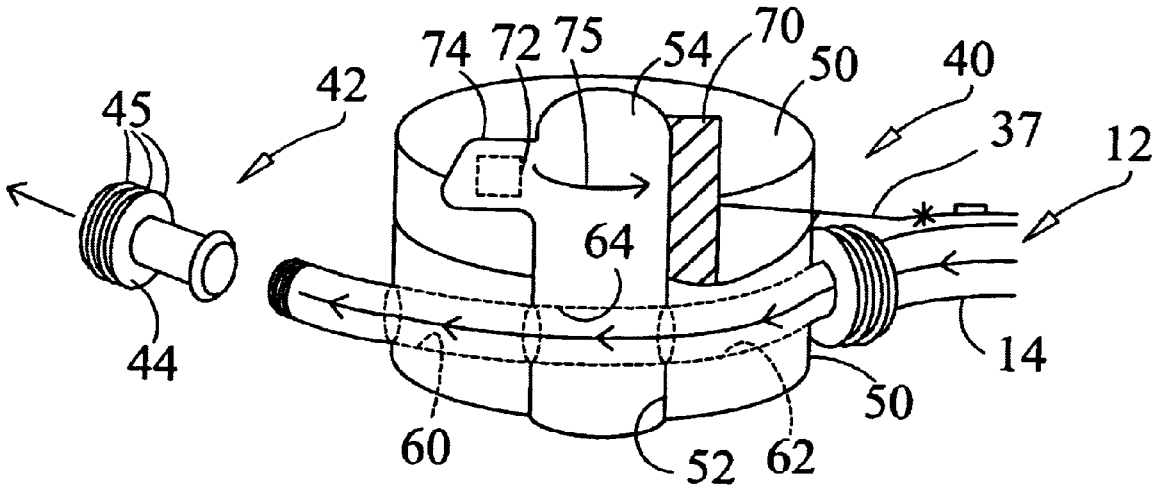
FIG. 8 is a perspective view in partial cutaway and exploded form of the various operative components of the present invention including but not limited to an adaptor assembly and a flush valve assembly.
Figure 9:
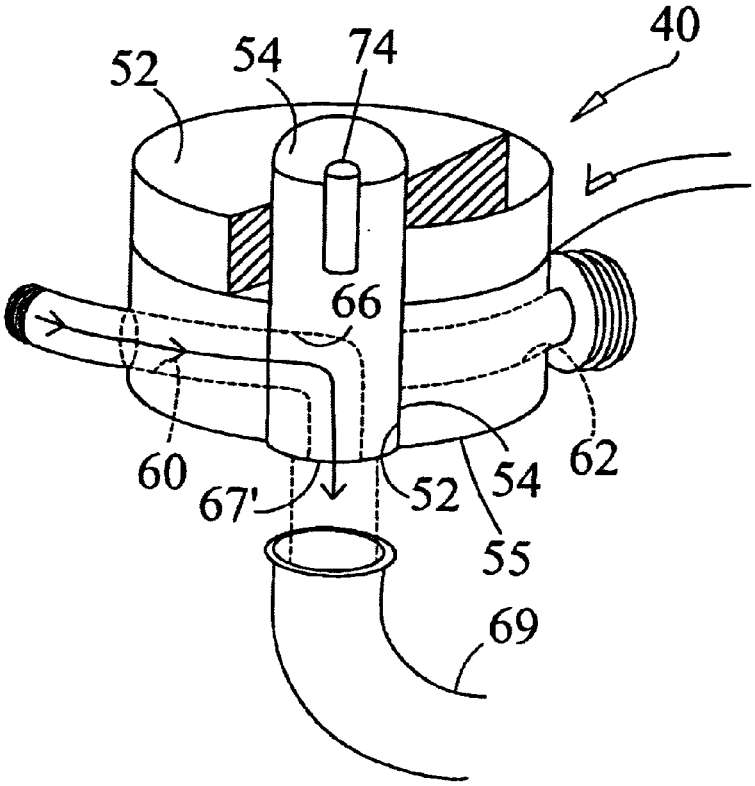
FIG. 9 is a perspective view in partial cutaway of the embodiment of FIG. 8 in a different mode of operation.
Figure 11:
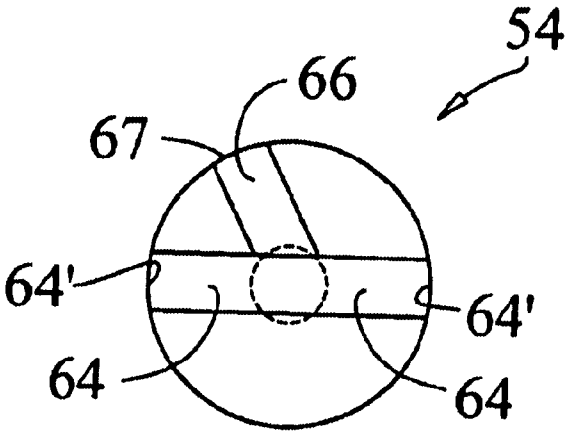
FIG. 11 is a sectional view taken along line 11—11 of FIG. 10.
Figure 10:
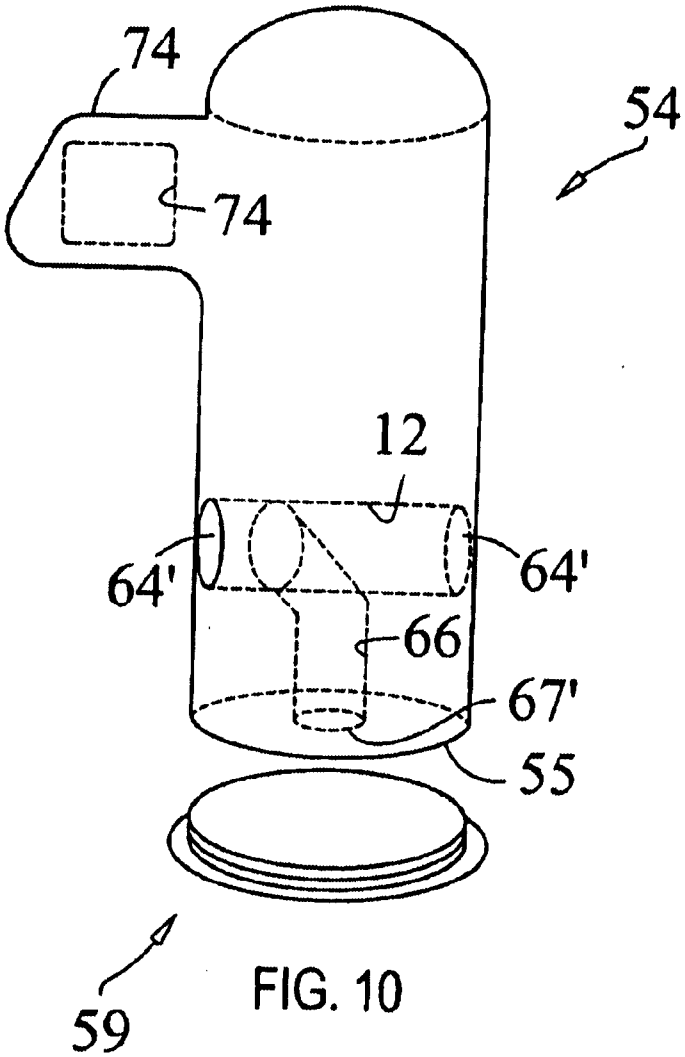
FIG. 10 is an operative component associated with the flush valve assembly of the flushing assembly and system of the present invention.

With reference to FIG. 8, the adaptor member 44 may assume a variety of different structures such as including a threaded or other attachment portions 45 which facilitates its mounting directly on or into the conventional water outlet 43 and 43' associated with the cooling system of the marine engines 25. As such, the adaptor member 44 is disposed and structured for direct fluid communication with the cooling system of the marine engine 25. Accordingly, during the flushing procedure, each adaptor member 44 is disposed and structured to allow the passage of fresh water therethrough into the water outlet 43 and throughout the cooling system, wherein it eventually exits through the conventional cooling water inlet 47, associated with the marine engine 25. Alternatively, when the marine engine is operating in the intended manner to power the water craft 23, water will flow from the body of water on which the craft is operating into the cooling water inlet 47, through the cooling system and out through the conventional water outlet 43. The cooling water passes through the adaptor member 42 as the cooling water is discharged from the marine engine 25.

Another feature of the flushing assembly and system 10 of the present invention comprises the aforementioned flush valve assembly 40. The flush valve assembly is disposed and structured to at least partially regulate fluid flow both into and out of the cooling system of the marine engine 25. As such, at least one preferred embodiment of the present invention comprises the location of an individual flush valve assembly 40 substantially adjacent to and in fluid communication between the path of fluid flow 12 and the one or more adaptor assemblies 42. Accordingly, as shown in the various Figures, an individual flush valve assembly 40 is associated with each of the adaptor members 44. However, it is further contemplated within the spirit and scope of the present invention that a single flush valve assembly 40 be disposed in fluid communication between the path of fluid flow 12 and a plurality of adaptor members 44 as well as the corresponding marine engines 25 on which they are mounted.

In either of the preferred embodiments set forth above and as disclosed in FIGS. 8 through 13, the flush valve assembly 40 comprises a valve housing 50 having an open chamber 52 formed therein. The open chamber 52 is dimensioned and configured to movably and/or rotatably receive a valve member 54 therein. Accordingly, the valve member 54 may be selectively movable relative to the housing 50 into a plurality of operative positions. The particular operative positions assumed by the valve member 54 determines or regulates the flow of water either into the cooling system of the marine engine 25 or out of the cooling system of the marine engine 25, during the respective flushing or cooling of the marine engine 25. As will be explained in greater detail hereinafter, the selective positioning of the valve member 54 relative to the valve housing 50 may be remotely controlled and electrically activated. Alternatively, the valve member 54 may be selectively oriented between anyone of the plurality of operative positions manually by physical manipulation of a handle or knob portion 74. Further, appropriate seal structures 59 may be mounted on the housing 50 and/or valve member 54 to prevent leakage of water within or from the flush valve assembly.

Figure 7:
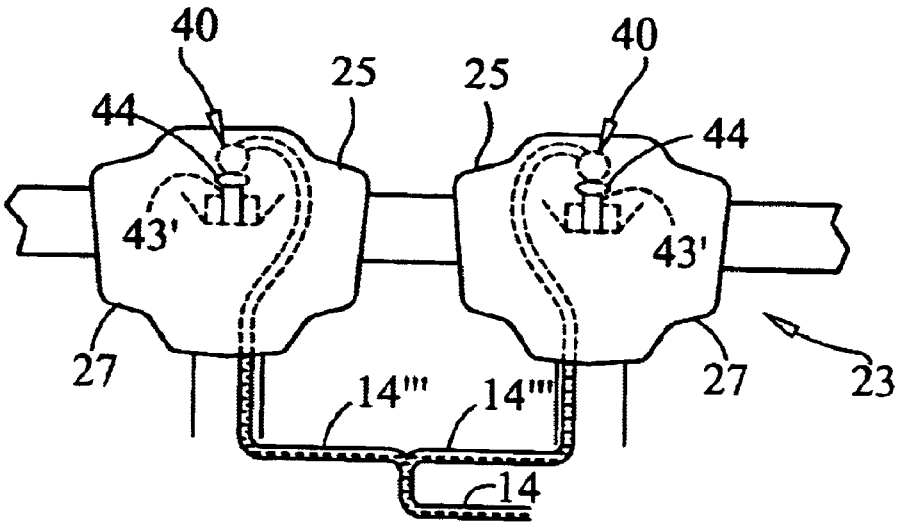
FIG. 7 is a top view in partial cutaway of the embodiment of FIG. 6.

As further shown in detail in FIGS. 8 through 13, the valve housing 50 comprises a first passage 50 and a second passage 62 both integrally formed therein. First passage 60 is fixedly disposed or interconnected in fluid communication with the fluid outlet 43 or 43' of the marine engine 25 through a corresponding one of the adaptor members 44. The second passage 62 is disposed in fixed, fluid communication with the path of fluid flow 12 by being interconnected to the conduit 14. Cooperative structuring of the valve member 54 includes a first path segment 64 preferably transversely oriented so as to extend completely through the valve member 54 and further including oppositely disposed open ends 64'. In addition, the valve member 54 includes a second path segment 66. The second path segment 66 has a first open end 67 formed in a side wall of the valve member 54 in spaced but substantially coplanar relation to each of the open ends 64' of the first path segment 64. However, the opposite open end 67' of the second path segment 66 is contiguous to an end portion 55 of the valve member 54. Therefore, the disposition and configuration of the second path segment 66 may serve to interconnect the cooling system of the marine engine with an external area of discharge of the cooling water which is discharged from the marine engine 25 during the operation thereof. With reference to FIG. 7 a discharge conduit or like structure 69 may or may not be secured to the open end 67' of the second path segment 66 so as to direct water to a more specific area for removal after it has been discharged from the conventional water outlet 43 or 43' of the marine engine 25.

As set forth above, flow of fresh water into the marine engine 25 or discharge of cooling water therefrom is dependent upon the selective orientation of the valve member 54, and accordingly the valve assembly 40, into one of a plurality of operative positions. Moreover, a first operative position is defined by the valve assembly 40 establishing fluid communication between fresh water 22, from the maintained water supply 16, passing along the path of fluid flow 12 through the second passage 62 of the valve housing 50 into and through the first path segment 64 of the valve member 54 and into the adaptor assembly or individual adaptor member 44. The flow of fresh water next passes into the conventional water outlet 43, through the cooling system of the marine engine 25 and out through the conventional cooling water inlet 47. When in the first operative position fresh water 22 from the maintained water supply 16 is forced to flow due to the operation of the water pump 30 towards and through the flush valve assembly 40 through the adaptor assembly 42 into the marine engine 25 as set forth above.

However, when it is desired to operate the one or more marine engines 25 in the normal fashion, the flush valve assembly 40 and in particular the valve member 54 is selectively oriented in a second operative position. As such, open end 67 of the second path segment 66 of the valve member 54 is aligned with the first passage 60 of the valve housing 50 (see FIG. 9). In this second operative position cooling water exiting the conventional water outlet 43 is passed through the corresponding adaptor 45 into the flush valve assembly 40, through the open end of first passage 60, into the second path segment 66. The water thereafter exits the open end 67'. As set forth above, the open end 67' may discharge the water directly to a preferred exterior discharge area or be connected to a discharge conduit 69 for directing of the discharged water to a more specific area.

As also set forth above, at least one preferred embodiment of the present invention comprises the remote control and preferably the electrical activation of the valve assembly 40 so as to selectively dispose the flush valve assembly 40 and in particular the valve element 54 between the plurality operative positions, as described above. Remote control the flush valve assembly 40 may be accomplished by manipulation of a control switch and/or other control structure 38, preferably located on the control console 26. In at least one embodiment the control structure may comprise a specific and designated positioning of an ignition key or an "on/off" switch associated with the console 26, as indicated by directional arrow 38'.

Figure 13:
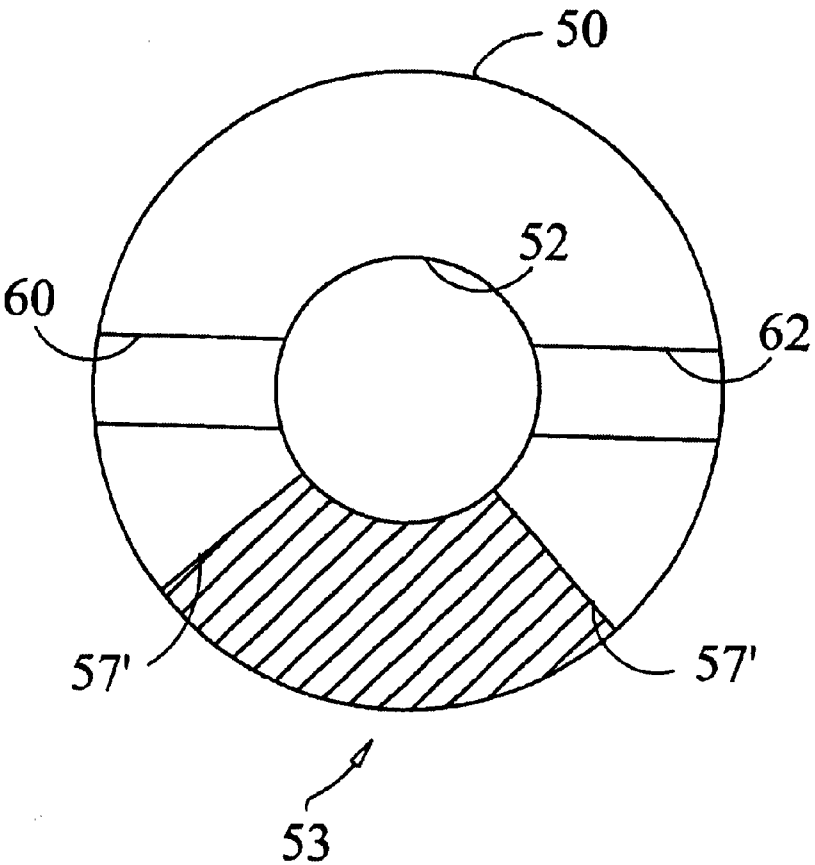
FIG. 13 is a transverse sectional view of the embodiment of FIG. 12.
Figure 12:
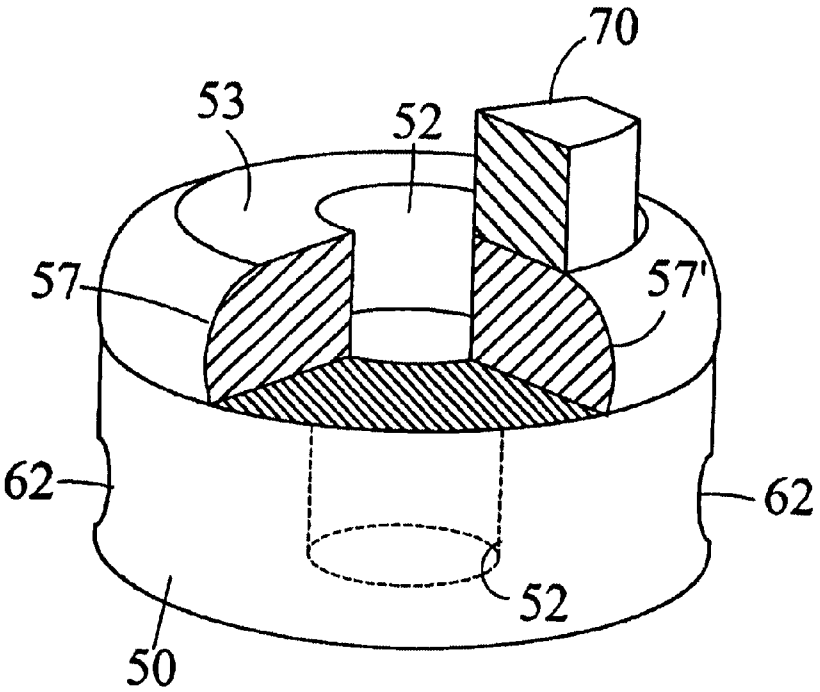
FIG. 12 is another operative component of the flush valve assembly of the resent invention.

Electrical activation of the flush valve assembly 40 may be accomplished by the inclusion of an electric and/or magnetic switching structure. More specifically, at least one preferred embodiment of the present invention includes an electromagnet 70 mounted on the housing 54 and disposed in communicating relation with a permanent magnet (or other electromagnet) 72 located on an appropriate portion of the valve member 54. The magnet 72 may be fixed to a nob or handle member 74 and movable with the valve member relative to the housing 50. The valve housing 50 includes a recess or cut out portion generally indicated as 53 wherein the handle or knob 74 is allowed to pass between the end stop portions 57 and 57' as best shown in FIGS. 12 and 13. Regardless of its position within recess 53, the magnet 72 is maintained in sufficiently close relation to the electromagnet 70 to be influenced by the magnetic field generated by the electromagnet 70 when it is pulsed or energized by current from the conductor 37.

More specifically, magnet 72 may have its polarity arranged such that a change of polarity of the electromagnet 70, due to current flow through electrical conductor 37, will serve to either repulse or retract the permanent magnet 72 relative to the electromagnet 70. By way of example, electrical pulsing of the electromagnet 70 regulates the polarity of the electromagnet 70 so as to be opposite to that of the permanent magnet 74. Since it is well recognized that unlike poles are attracted to one another, the valve member 54 would be forced to rotate since the permanent magnet 72 would be attracted to and towards the electromagnet 70 as indicated by directional arrow 75. This would rotate or otherwise orient the valve member 54 from the first operative position shown in FIG. 8 to the second operative position shown in FIG. 9. Similarly, proper manipulation of the control switch or structure 38 on the control console 26 could change the polarity of the electromagnet 70 to the same as that of the permanent magnet 74 causing the valve member 54 to rotate in an opposite direction and force the valve member 54 into the first operative position as described above. The flush valve assembly 40 may also take a variety of other structural configurations and still be electrically activated by the remote control structure 38. Such an alternative flush valve assembly may comprise or at least structurally and/or operatively resemble a solenoid valve.

Figure 2:
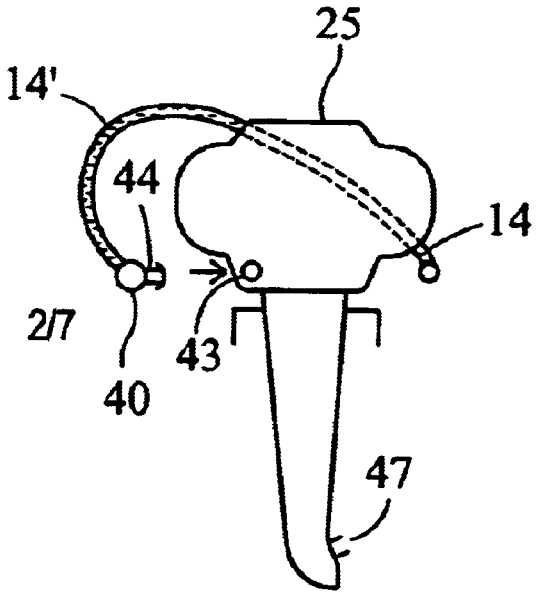
FIG. 2 is a side view in partial cutaway of one of two marine engines and at least some of the operative components of the flushing assembly of the present invention in relation thereto.
Figure 3:
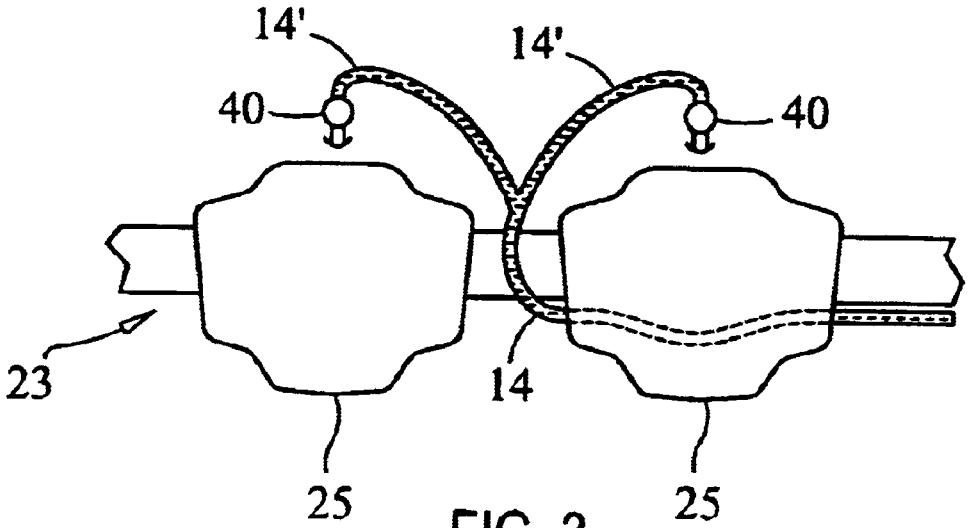
FIG. 3 is a top view in partial cutaway of the embodiment of FIG. 2 including an adaptor assembly and flush valve assembly being attached to two marine engine associated with the water craft.
Figure 4:
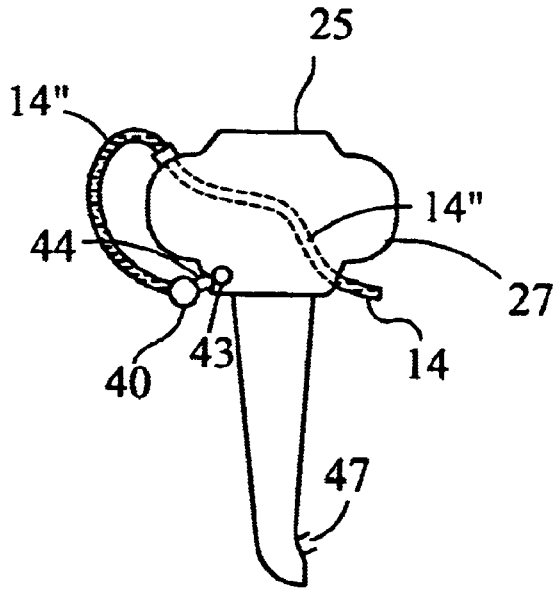
FIG. 4 is a side view of another embodiment of the flushing assembly and system of the present invention which differs from the embodiment of FIGS. 2 and 3.
Figure 5:
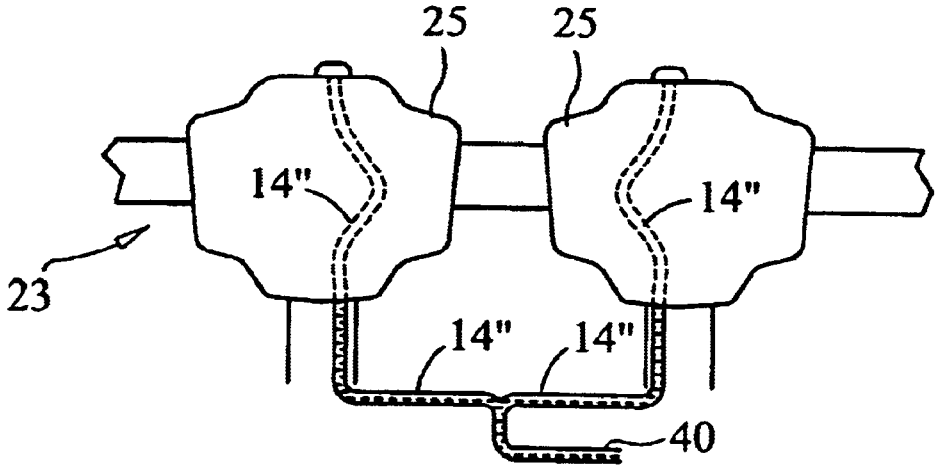
FIG. 5 is a top view in partial cutaway of the embodiment of FIG. 4.
Figure 6:
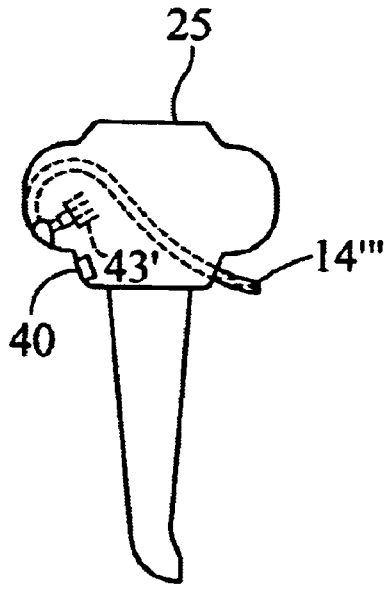
FIG. 6 is a side view of yet another embodiment of the flushing assembly and system of the present invention.

The versatility of the various preferred embodiments of the present invention is further demonstrated by the fact that the flushing assembly and system 10 of the present invention can be utilized with existing marine engines 25, such as by being connected by conduit 14 and conduit segments 14' completely on the exterior of the one or more marine engines 25 as demonstrated in FIGS. 2 and 3. Also at least a portion of the flushing assembly and system 10, such as the conduit segments 14" could be mounted at least partially within the cowling or interior 27 of the one or more marine engines 25, while being connected to the cooling water outlet 43 on an exterior thereof as demonstrated in FIGS. 4 and 5. Alternatively, the flushing assembly and system of the present invention could be an original part of the marine engines 25 and therefore comprise an OEM product as demonstrated in FIGS. 6 and 7. In this embodiment the adaptor members 44 and the respective flush valve assemblies 40 would be connected on the interior of the cowling 27 to an appropriate portion of the cooling system such as an outlet portion 43'.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed:

1. A flushing assembly structured for flushing at least one marine engine of a water craft, with fresh water from an on board, maintained water supply said flushing assembly comprising:

(a) a maintained water supply disposed on-board the water craft, (b) a path of fluid flow disposed in fluid communication with the maintained water supply and extending therefrom to the marine engine, (c) a flush valve assembly interconnecting said path of fluid flow in fluid communication with the marine engine, (d) said fluid valve assembly selectively disposable between at least a first operative position and a second operative position, (e) said first operative position comprising fresh water passing through said valve assembly from said path of fluid flow into a cooling system of the marine engine; and (f) said second operative position comprising cooling water passing from the cooling system through said valve assembly upon being discharged from the marine engine.

2. An assembly as recited in claim 1 further comprising an adaptor assembly secured to the marine engine and disposed in interconnecting relation between said flush valve assembly and the cooling system.

3. An assembly as recited in claim 2 wherein, said adaptor assembly is disposed and structured to allow fresh water and cooling water to independently pass there through and respectively into and out of the cooling system.

4. An assembly as recited in claim 3 wherein said adaptor assembly is cooperatively disposed and structured with said flush valve assembly such that the passage of fresh water or cooling water there through is dependent on whether said flush valve assembly is in said first operative position or said second operative position.

5. An assembly as recited in claim 4 wherein said adaptor assembly comprises an adaptor member secured to a cooling water outlet of the marine engine, said adaptor member interconnected in fluid communication between the cooling system and said, flush valve assembly.

6. An assembly as recited in claim 5 wherein said adaptor member is permanently secured to the cooling water outlet of the marine engine.

7. An assembly as recited in claim 5 wherein said flush valve assembly and said adaptor member are disposed exteriorly of the marine engine.

8. An assembly as recited in claim 5 wherein said flush valve assembly and said adaptor member are disposed on an interior of the marine engine.

9. An assembly as recited in claim 1 wherein said flush valve assembly comprises at least a first path segment disposed in fluid communication between said path of fluid flow and the cooling system when said flush valve assembly is in said first operative position.

10. An assembly as recited in claim 9 wherein at least a second path segment is disposed in fluid communication with the cooling system and an exterior of the marine engine when said flush valve assembly is in said second operative position.

11. An assembly as recited in claim 10 wherein said valve assembly is electrically activated to selectively orient said flush valve assembly in either said first or second operative positions.

12. An assembly as recited in claim 10 wherein said valve assembly is remotely controlled.

13. An assembly as recited in claim 12 wherein said flush valve assembly comprises an electromagnetic switching assembly connected thereto and structured to selectively orient said valve assembly to establish respective operative positions of said first and second flow path segments.

14. An assembly as recited in claim 1 wherein said flush valve assembly comprises a housing including at least a first passage and a second passage, said first passage connected in fluid communication with the cooling water outlet of the marine engine and said second passage connected in fluid communication with said path of fluid flow.

15. An assembly as recited in claim 14 wherein said flush valve assembly further comprises a valve member disposed on said housing and including at least a first path segment and a second path segment mounted thereon and movable with said valve member relative to said housing.

16. An assembly as recited in claim 15 wherein said valve member is selectively positionable between said first operative position and said second operative position.

17. An assembly as recited in claim 16 wherein said first operative position comprises said first path segment disposed in fluid communication with both said first and second passages.

18. An assembly as recited in claim 17 wherein said first operative position further comprises said path of fluid flow disposed in fluid communication with the cooling system of the marine engine through said valve assembly.

19. An assembly as recited in claim 18 wherein said path of fluid flow, said valve assembly and the cooling system of the marine engine are all disposed in fluid communication with one another when said valve member is in said first maintained water supply is delivered to the cooling system of the marine engine.

20. An assembly as recited in claim 19 wherein said second operative position comprises said second path segment disposed in fluid communication with said second passage.

21. An assembly as recited in claim 20 wherein said second operative position further comprises the cooling system disposed in fluid communication with an exterior of the marine engine through said valve assembly.

22. An assembly as recited in claim 21 wherein said valve assembly and the cooling system of the marine engine are disposed in fluid communication with one another when said valve assembly is in said second operative position such that cooling water passing through the cooling system is discharged therefrom through said valve assembly.

23. An assembly as recited in claim 16 wherein said valve assembly is electrically activated to selectively orient said valve assembly in either said first operative position or said second operative position.

24. An assembly as recited in claim 16 wherein said second operative position comprises said second path segment disposed in fluid communication with said first passage.

25. An assembly as recited in claim 24 wherein said second operative position further comprises the cooling system disposed in fluid communication with an exterior of the marine engine through said flush valve assembly.

26. An assembly as recited in claim 25 wherein said flush valve assembly and the cooling water outlet of the marine engine are disposed in fluid communication with one another when said valve element is in said second operative position such that cooling water passing through the cooling system is discharged therefrom through said valve assembly.

27. A flushing assembly for flushing a cooling system of a marine engine on a water craft said flushing assembly comprising:

(a) a maintained water supply disposed on-board the water craft, (b) a path of fluid flow disposed in fluid communication with the maintained water supply and extending therefrom to the marine engine, (c) an adaptor assembly secured to the marine engine in fluid communication with the cooling system and said path of fluid flow, (d) a flush valve assembly interconnected between said path of fluid valve and said adaptor assembly and structured to regulate fluid flow into and out of the cooling system, (e) said flush valve assembly being positionable into each of a plurality of operative positions, and (f) each of said plurality of operative positions being determinative of either fresh water from the maintained water supply or cooling water from an exterior of the marine engine passing through the cooling system.

28. An assembly as recited in claim 27 herein said flush valve is electronically activated and remotely controlled to regulate movement thereof between said plurality of operative positions.

29. An assembly as recited in claim 27 wherein said flush valve is manually operable.

30. An assembly as recited in claim 27 wherein said adaptor assembly comprises an adaptor member permanently secured to a cooling water outlet of the marine engine, said adaptor member disposed in interconnected fluid communication with said path of fluid flow, said flush valve assembly and the cooling system.

31. An assembly as recited in claim 27 wherein said plurality of operative positions comprise at least a first operative position comprising fresh water passing through said valve assembly from said path of fluid flow into the cooling system of the marine engine.

32. An assembly as recited in claim 31 wherein said second operative position comprises cooling water passing from the cooling system through said valve assembly upon being discharged from the marine engine.

33. A flushing system for a marine engine on a water craft, said flushing system comprising:

(a) a maintained water supply disposed on-board the water craft, (b) a path of fluid flow disposed in fluid communication with said maintained water supply and extending therefrom to the marine engine, (c) a pump assembly disposed and structured to force liquid flow along said path of fluid flow, (d) a flush valve assembly interconnected between said path of fluid flow and said adaptor assembly and structured to regulate fluid flow into and out of the cooling system, and (e) said flush valve assembly being positionable into each of a plurality of operative positions and being determinative of either fresh water from the maintained water supply or cooling water from an exterior of the marine engine passing through the cooling system.

34. An assembly as recited in claim 33 wherein said plurality of operative positions comprise at least a first operative position comprising fresh water passing through said valve assembly from said path of fluid flow into the cooling system of the marine engine.

35. A system as recited in claim 34 wherein said second operative position comprises cooling water passing from the cooling system through said valve assembly upon being discharged from the marine engine.

36. A system as recited in claim 33 wherein said adaptor assembly comprises an adaptor member permanently secured to a cooling water outlet of the marine engine, said adaptor member disposed in interconnected fluid communication with said path of fluid flow, said flush valve assembly and the cooling system.

37. A system as recited in claim 33 wherein said maintained water supply comprises a primary reservoir of potable water for the water craft.

38. A system as recited in claim 33 wherein said maintained water supply comprises an auxiliary reservoir of fresh water.

* * * * *